US005314011A

United States Patent [19]

Leidinger et al.

[11] Patent Number: 5,314,011

[45] Date of Patent: May 24, 1994

[54] HEAT PIPE

[75] Inventors: Bernhard Leidinger, Mülheim; Ruediger Meyer; Klaus P. Nickel, both of Bremen, all of Fed. Rep. of Germany

[73] Assignee: ERNO Raumfahrttechnik GmbH, Bremen, Fed. Rep. of Germany

[21] Appl. No.: 79,323

[22] Filed: Jun. 17, 1993

[30] Foreign Application Priority Data

Jun. 17, 1992 [DE] Fed. Rep. of Germany ..... 4219781

[51] Int. Cl.[5] ..... F28D 15/02

[52] U.S. Cl. ..... 165/104.26; 122/366

[58] Field of Search ..... 165/104.26

[56] References Cited

U.S. PATENT DOCUMENTS 3,844,342 10/1974 Eninger et al. ..... 165/104.26
4,058,159 11/1977 Iriarte ..... 165/104.26
4,854,379 8/1989 Shaubach et al. ..... 165/104.26

OTHER PUBLICATIONS

Heat Pipe Design Handbook, vol. 1, by B&K Engineering Inc. pp. 149 & 152.

*Primary Examiner*—Albert W. Davis, Jr.
*Attorney, Agent, or Firm*—W. F. Fasse; W. G. Fasse

[57] ABSTRACT

A heat pipe is divided longitudinally by a divider wall into a vapor channel and into a liquid channel. The divider wall is provided, preferably at uniform axial spacings with bulges that form a restriction in the flow cross-sectional area of the vapor channel and an increase in the flow cross-sectional area of the liquid channel. A small diameter through bore is positioned at the peak of each bulge to connect the liquid channel with the vapor channel at this point. The reduced pressure at the restriction in the vapor channel is sufficient to suck gas or vapor bubbles collected under the bulge into the vapor channel, but insufficient to pull liquid into the vapor channel. The cross-sectional flow area of the liquid channel increases steadily toward each bulge, either from a point centrally between two bulges or from a point directly downstream of a bulge toward the next bulge as viewed in the flow direction of the liquid.

5 Claims, 1 Drawing Sheet

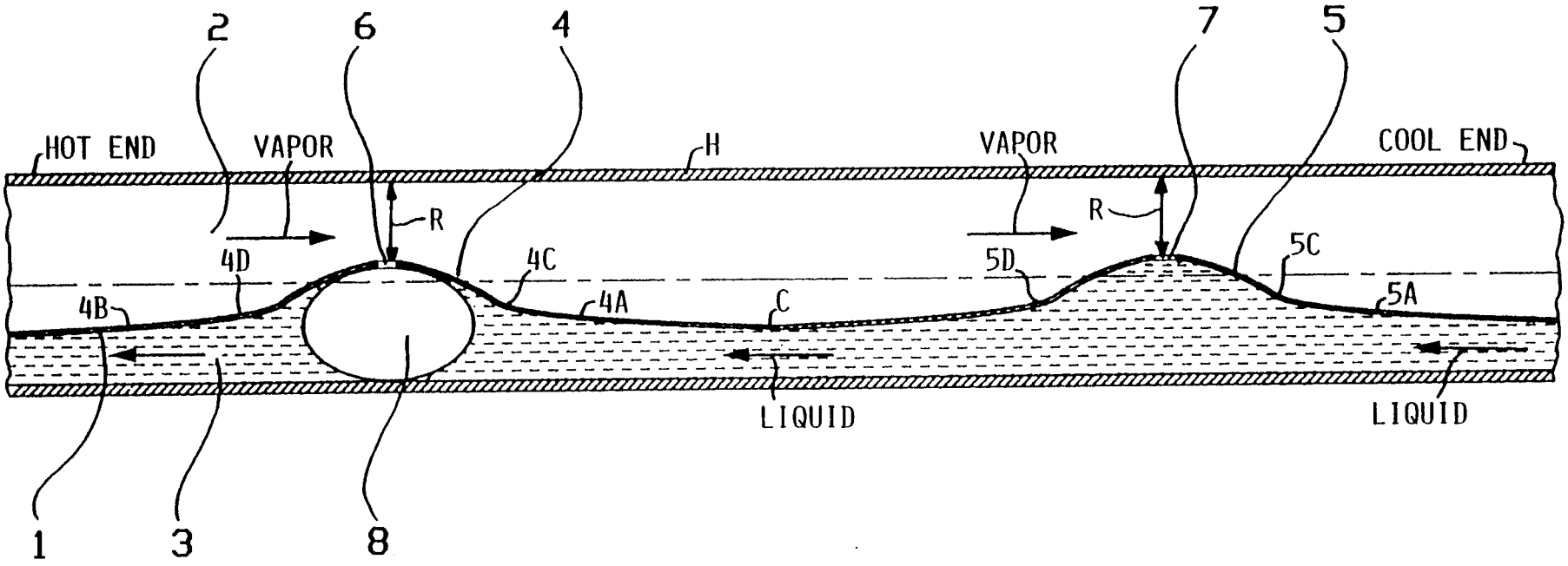
COOL END
5
7
VAPOR
R
H
4
6
VAPOR
2
HOT END
5A
5C
5D
C
4A
4C
R
4D
4B
LIQUID
LIQUID
8
3
1

HEAT PIPE

FIELD OF THE INVENTION

The invention relates to a heat pipe for transferring heat, for example, in a spacecraft. The heat pipe includes a conduit divided lengthwise to form at least two channels, one for a liquid heat carrier flow and one for a vaporized heat carrier flow.

BACKGROUND INFORMATION

Heat pipes are known in the art for transporting heat from one location to be cooled to another location in which the heat is to be dissipated. The need for heat removal exists in many environments extending from electronic circuit boards to cooling a spacecraft. A heat pipe uses a liquid as a heat carrier which is evaporated at the hot end of the heat pipe and the vapor is converted back into a liquid at the cool end of the pipe. Conventionally, ammonia is used as the heat carrier which in its vapor form transports heat from the hot end of the pipe to the cool end of the pipe where the vapor condenses, thereby discharging heat to the environment and the condensate flows back to the hot end of the pipe.

The vapor flow from the hot end to the cooler end is maintained due to the pressure difference between the hot and cool ends. The liquid flow back to the hot end is either a gravitational flow if the heat pipe is positioned vertically or it is a capillary flow if the heat pipe is positioned other than vertically. Different radii of curvature in the boundary surface between the liquid and the vapor at the evaporating hot end, on the one hand, and at the condensating end on the other hand, generate capillary forces which cause the condensate to flow back while the pressure difference between the evaporating and condensating end causes the vapor to flow from the hot to the cool end. The resulting flow velocity depends on the equilibrium that is established between the pressure loss due to frictional forces and the effective capillary forces.

Modern high performance heat pipes are capable of transporting substantial heat quantities over substantial distances even at relatively small temperature differences between the hot and cold end of the heat pipe. For example, one kilowatt can be easily transported over distances from 1 to about 20 m. Higher heat quantities have been transported over shorter distances.

Comparing conventional high performance heat pipes with other conventional heat pipes, the higher performance of the former is achieved in that the transport of the liquid takes place through channels of differing dimensions. In the vaporization zone a multitude of very small channels having geometries for capillary action are used in order to achieve substantial driving capillary forces. In the condensating zone and in the section between the evaporating and condensating zones, the transport takes place through few flow channels and if suitable even in a single channel with a relatively large diameter. Such a large diameter channel may also be referred to as an artery. The just described structure minimizes pressure losses due to frictional forces. As a result, a substantially increased fluid mass flow is achieved even though the capillary forces remain the same. Simultaneously, a substantially increased heat transfer or heat flow is achieved due to the improved mass flow.

In operating such high performance heat pipes, however, a substantial problem is encountered. Such a problem is caused by vapor bubbles of the heat carrier fluid or by gaseous noncondensible foreign matter. Bubbles and noncondensible matter impair the function of a heat pipe substantially or may even interrupt the operation. Such bubbles or foreign matter may have been present inside the heat pipe already at the time of starting the operation and their presence may have been complete accidental. Such impairments may also be caused by an operational overloading of the heat pipe, for example, by superheating the evaporation end of the pipe causing a short duration, temporary drying of the evaporation zone. Resulting bubbles can interrupt the transport of the heat carrier fluid to the hot end of the pipe so that the hot end even dries further, thereby blocking the further function of the heat pipe.

Two conventional heat pipes are described in "Heat Pipe Design Handbook", Volume 1, by B+K Engineering Incorporated, Towson, Maryland, 21204 (U.S.A.), pages 149 and 152. These conventional heat pipes include devices for the removal of bubbles and thus avoiding the blockage of the desired flow by the gas bubbles. In one instance, gas bubbles are avoided by venting bores in the separation wall between the artery and the vapor channel. In the other instance the gas bubbles are avoided by a suction nozzle arranged in the transport area for the vapor. The suction nozzle functions simultaneously as a jet pump for sucking off gas bubbles in the artery through a suction pipe.

The arrangement of venting holes in the wall of the artery has the disadvantage that during the operation of the heat pipe the pressure in the vapor channel is substantially higher than in the artery so that for transferring gas bubbles out of the artery into the vapor channel, the operation of the heat pipe must be interrupted. However, during such interruption the venting bores are blocked by liquid bridges which must first evaporate before the gas bubbles can pass through the venting bores. As a result, such interruptions of the operation of the heat pipe require relatively long time periods before the heat pipe can become operational again.

With regard to the second conventional devices for the removal of bubbles by a suction nozzle or venturi nozzle, there is the disadvantage that, in case there is no gas bubble within the suction range of the suction nozzle, a small quantity of heat carrier fluid is collected from the artery into the suction pipe. If now a gas bubble does appear in front of the suction inlet, it is necessary to first suck in the liquid quantity out of the suction pipe to be able to also remove the gas bubble. The result is a substantial pressure loss in the flow in the suction pipe. As a result, the pressure reduction caused thereby in the suction nozzle is correspondingly substantial. Thus, the nozzle must have a relatively large reduction in the cross-sectional flow area. Such a reduction in turn leads to a substantial impairment of the vapor flow, due to the pressure loss and thus to a substantially reduced effectiveness of the heat pipe.

OBJECTS OF THE INVENTION

In view of the foregoing it is the aim of the invention to achieve the following objects singly or in combination:

to construct a heat pipe of the type described, in such a manner that vapor bubbles of the heat carrier fluid and bubbles of a noncondensatable gas are reliably removed from the flow channel of the fluid during the operation of the heat pipe;

to avoid the interruption of the normal operation of the heat pipe for the purpose of the bubble removal, in other words, bubbles are to be removed during the operation of the heat pipe and without substantially impairing the capacity or efficiency of the heat pipe;

to construct a heat pipe in such a manner that it is not trouble-prone and hence highly reliable in its operation;

to assure a completely automatic removal of gas and vapor bubbles during the operation of the heat pipe; and to avoid the pitfalls of prior art attempts at efficiently removing gas and vapor bubbles from a heat pipe.

SUMMARY OF THE INVENTION

According to the invention a heat pipe having a first higher temperature end and a second lower temperature end is formed by a hollow conduit that is closed at both ends and divided between the ends longitudinally by a divider wall which forms a first channel for conveying a heat exchange fluid in its vapor state and a second channel for conveying the heat exchange fluid in its liquid state. The vapor flows from the warmer end to the cooler end and the liquid flows from the cooler end to the warmer end. The divider wall is formed with bulges which reach into the first channel for forming flow restrictions in the first channel for the vapor and for forming an increased flow cross-section area in the second channel for the liquid. The bulges are spaced from one another in the longitudinal direction inside the hollow conduit and through bores are provided in the bulges for interconnecting the first vapor channel with the second liquid channel.

It has been found that the features of the invention have a minimal influence on the maximally obtainable heat transport capacity while simultaneously providing a heat pipe that is highly reliable in its operation. The invention combines venting bores with suction nozzles in such a way that the above outlined disadvantages are avoided while their advantages are utilized.

The heat pipe according to the invention assures a completely automatic suction removal of any gas or vapor bubbles that may occur.

The degassing of the heat pipe according to the invention is possible even during its operation, because the pressure reduction caused by the venturi valve is located directly above the suction bore for the gas or vapor bubbles, whereby the use of a suction pipe is avoided. Avoiding a suction pipe in turn has the advantage that the requirements for the pressure drop necessary for the suction removal in the area of the venturi nozzle are substantially reduced. As a result, any reduction in the efficiency of the heat pipe is also minimized compared to conventional devices.

BRIEF DESCRIPTION OF THE DRAWING

In order that the invention may be clearly understood, it will now be described, by way of example, with reference to the single figure of the accompanying drawing, which shows a longitudinal section through a portion of the heat pipe according to the invention.

DETAILED DESCRIPTION OF PREFERRED EXAMPLE EMBODIMENTS AND OF THE BEST MODE OF THE INVENTION

The heat pipe portion shown in the Figure is positioned between the vaporizing hot end of the pipe and the condensating cool end of the pipe. According to the invention, the heat pipe H is divided longitudinally by a divider wall 1, such as a profiled sheet metal member forming a first channel 2 for the vapor flow as indicated by the respective arrows and a second channel 3 for the liquid flow as also indicated by the respective arrows. The heat carrier medium is evaporated at the hot end and travels in the form of vapor from left to right where the vapor is condensed again at the cool end and the resulting condensate or liquid travels from right to left back to the hot end.

According to the invention the divider wall 1 is provided with bulges 4 and 5 which are axially spaced from one another at preferably uniform intervals which have, for example, an on-center spacing of 1 m. The bulges 4 and 5 project into the vapor channel 2, thereby forming restrictions R in the vapor channel while simultaneously forming enlarged cross-sectional flow areas in the liquid channel 3. Each bulge 4, 5 is provided with a through bore 6, 7, preferably positioned centrally at the peak of the bulge and respectively in the bottom of the valley. These through bores have, for example, a diameter of 0.2 mm.

According to the invention the divider wall 1 is further so shaped that the bulges 4 and 5 emerge out of a slightly rising wall section 4A, 5A and merge into a slightly falling wall section 4B, 5B as viewed in the direction of the liquid flow representing arrows in the channel 3. As a result of this construction, the liquid channel 3 has a cross-sectional flow area which increases toward the bulges 4, 5 and decreases away from these 4,5 in this embodiment, whereby the cross-sectional flow area of the channel 3 increases steadily along the divider wall sections 4A and 5A and decreases symmetrically along the wall sections 4B and 5B. The cross-sectional flow area increases with a step where the bulge begins at 4C and 5C and decreases again with a step where the bulge ends at 4D and 5D. The cross-sectional flow area of the channel 3 is smallest at a central point C intermediate the peaks of the bulges 4 and 5. At that point C the cross-sectional flow area of the vapor channel 2 is largest while the cross-sectional flow area of the liquid channel 3 is smallest.

As shown in the Figure, a bubble 8 has collected in the liquid channel 3 below the bulge 4 during the operation of the heat pipe. The bubbles are transported in the direction of the arrows representing the liquid flow until they are collected below a bulge. Simultaneously, the velocity of the vapor flow in the channel 2 is increased next to the bulge due to the restriction R formed by the bulge. These flow velocity increases of the vapor flow take place at each bulge. Simultaneously, with the velocity increase the local pressure above the respective through bores 6 and 7 is correspondingly reduced so that the gas or vapor bubble 8 is sucked off through the bore 6 into the vapor channel 2.

It has been found that bubbles located initially, that is prior to starting the operation of the heat pipe, intermediate the bulges 4, 5, tend to travel toward these bulges and collect below the nearest bulge. Such travel is caused by capillary forces which in turn result from the above described configuration of the divider wall 1 which provides a continuous increase in the cross-sectional flow area of the liquid channel toward the respective bulge as viewed in the liquid flow direction.

Furthermore, the bulges 4 and 5 and the diameter of the through bores 6 and 7 are so correlated to one another that the pressure drop in the vapor channel 2 at each restriction R is so small that liquid in the area of the bulges is not sucked into the vapor channel. Rather, the capillary action keeps the liquid in the liquid channel 3 but permits the bubble to escape into the channel 2.

Rather than placing the smallest cross-sectional flow area of the liquid channel 3 at the point C centrally between two bulges, it is possible to place that smallest cross-sectional flow area at the exit end of each bulge, namely at 4D and 5D so that a continuous steady increase in the cross-sectional flow area does appear between points 4C and 5D, for example. Such an embodiment is especially suitable for the initial operational phase of the present heat pipe, because in such an embodiment the liquid flow and the capillary forces add each other in the same direction whereby gas and vapor bubbles in the liquid channel 3 are most effectively collected and discharged into the vapor channel through the holes 6, while liquid is still retained in the channel 3.

Although the invention has been described with reference to specific example embodiments, it will be appreciated that it is intended to cover all modifications and equivalents within the scope of the appended claims.

What we claim is:

1. A heat pipe having a first pipe end with a higher temperature and a second pipe end with a temperature lower than said higher temperature, comprising a hollow conduit closed at both ends, a divider wall dividing said hollow conduit into a first channel for conveying a heat exchange fluid in its vapor state from said first pipe end to said second pipe end and a second channel for conveying said heat exchange fluid in its liquid state from said second pipe end to said first pipe end, said divider wall comprising bulges therein reaching into said first channel for forming flow restrictions in said first channel for said vapor and for forming an increased flow cross-sectional area in said second channel for said liquid, said bulges being spaced by a lengthwise spacing in said hollow conduit, said divider wall further comprising through bores in said bulges for interconnecting said first and second channels.

2. The heat pipe of claim 1, wherein said lengthwise spacing has an on-center length of about one meter between neighboring bulges.

3. The heat pipe of claim 1, wherein said through bores have a bore diameter of about 0.2 mm.

4. The heat pipe of claim 1, wherein said divider wall is a profiled sheet metal member.

5. The heat pipe of claim 1, wherein said through bores are positioned in said divider wall at a peak with reference to said first channel and at a valley with reference to said second channel.

* * * * *